US006402299B1

(12) United States Patent
DeMeerleer et al.

(10) Patent No.: US 6,402,299 B1
(45) **Date of Patent: *Jun. 11, 2002**

(54) TAPE AUTOMATED BONDING CIRCUIT FOR USE WITH AN INK JET CARTRIDGE ASSEMBLY IN AN INK JET PRINTER

(75) Inventors: Jan Richard DeMeerleer; Brian Christopher Hart; James Michael Mrvos; Gary Raymond Williams, all of Lexington, KY (US)

(73) Assignee: Lexmark International, Inc., Lexington, KY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/425,094

(22) Filed: Oct. 22, 1999

(51) Int. Cl.[7] ..... B41J 2/14
(52) U.S. Cl. ..... 347/50
(58) Field of Search ..... 347/85, 86, 87, 347/50, 63

(56) References Cited

U.S. PATENT DOCUMENTS

| | | | | |
|---|---|---|---|---|
| 4,620,195 | A | 10/1986 | Eblen et al. | 347/49 |
| 4,679,059 | A | 7/1987 | Dagna | 347/50 |
| 4,698,644 | A | 10/1987 | Drago et al. | 347/40 |
| 4,794,463 | A | 12/1988 | Tamura et al. | 358/296 |
| 5,053,922 | A | 10/1991 | Matta et al. | 361/386 |
| 5,060,370 | A | 10/1991 | Scales, Jr. et al. | 29/846 |
| 5,189,787 | A | 3/1993 | Reed et al. | 29/831 |
| 5,212,503 | A | 5/1993 | Saito et al. | 347/59 |
| 5,278,584 | A | 1/1994 | Keefe et al. | 347/63 |
| 5,296,651 | A | 3/1994 | Gurrie et al. | 174/254 |
| 5,297,331 | A | 3/1994 | Childers | 29/611 |
| 5,372,512 | A | 12/1994 | Wilson et al. | 439/39 |
| 5,420,627 | A | 5/1995 | Keefe et al. | 347/87 |
| 5,422,667 | A | 6/1995 | Daggs et al. | 347/87 |
| 5,434,607 | A | 7/1995 | Keefe | 347/50 |
| 5,608,434 | A | 3/1997 | Wilson et al. | 347/50 |
| 5,610,642 | A | 3/1997 | Nobel et al. | 347/50 |
| 5,637,166 | A | 6/1997 | Swanson et al. | 156/73.1 |
| 5,686,949 | A | 11/1997 | Swanson et al. | 347/87 |
| 5,736,998 | A | 4/1998 | Caren et al. | 347/45 |
| 5,748,209 | A | 5/1998 | Chapman et al. | 347/50 |
| 5,751,323 | A | 5/1998 | Swanson et al. | 347/85 |
| 5,852,460 | A | 12/1998 | Schaeffer et al. | 347/87 |
| 5,896,153 | A | 4/1999 | Swanson et al. | 347/87 |
| 5,903,295 | A | 5/1999 | Swanson et al. | 347/87 |
| 5,940,729 | A * | 8/1999 | Downes, Jr. et al. | 438/613 |
| 5,953,032 | A * | 9/1999 | Haarz et al. | 347/87 |

* cited by examiner

*Primary Examiner*—Anh T. N. Vo
(74) *Attorney, Agent, or Firm*—D. Brent Lambert; Todd T. Taylor

(57) ABSTRACT

An ink jet cartridge assembly for use in an ink jet printer has a body with at least one inner ink chamber. A printhead is carried by the body and has a plurality of ink jetting orifices in fluid communication with the ink chamber. A tape automated bonding circuit carried by the body includes a flexible tape and a plurality of electrical traces. The flexible tape includes a chip window with a peripheral edge. The printhead is disposed within the chip window at a distance from the peripheral edge. Each electrical trace has a bottom side adjacent the body, a substrate held portion carried by the flexible tape, a free trace portion extending between the peripheral edge of the chip window and the printhead, and a printhead held portion connected with the printhead. The tape automated bonding circuit further includes a photoimagable coating which covers the bottom side of each electrical trace on all of the substrate held portion and the free trace portion, but does not cover the printhead held portion.

16 Claims, 2 Drawing Sheets

TAPE AUTOMATED BONDING CIRCUIT FOR USE WITH AN INK JET CARTRIDGE ASSEMBLY IN AN INK JET PRINTER

BACKGROUND OF THE INVENTION

1. Field of the Invention

The present invention relates to ink jet printers, and, more particularly, to tape automated bonding circuits for use with ink jet cartridge assemblies in an ink jet printer.

2. Description of the Related Art

An ink jet printer may include an ink jet cartridge assembly which is carried by a movable carriage assembly in transverse directions across the width of the print medium during printing. The ink jet cartridge assembly typically includes a body, a tape automated bonding (TAB) circuit and a printhead. The TAB circuit and the printhead are each carried by the body. The printhead includes a plurality of ink jetting orifices which are in communication with ink disposed within the body, and through which ink droplets are ejected onto the print medium in known manner. The TAB circuit includes a flexible tape which carries a plurality of electrical traces. The electrical traces are connected at one end thereof with the printhead and at an opposite thereof with a contact pad in a contact pad area. The contact pads engage corresponding electrical terminals on the movable carriage assembly when the ink jet cartridge is snapped into place, and allow individual heater elements within the printhead to be actuated to eject the droplets of ink onto the print medium during use. The electrical traces on the TAB circuit are typically in the form of copper traces which are formed via an etching process on the bottom side of the flexible tape adjacent the body.

During normal printing operations and maintenance operations of the ink jet printer, ink is ejected from the ink jetting orifices in the printhead of the ink jet cartridge assembly. This jetting of the ink exposes the electrical traces on the TAB circuit to aqueous ink. The presence of the aqueous ink on the electrical traces causes the traces to corrode at a relatively fast rate. Such corrosion is obviously not desirable, and shortens the operable life of the ink jet cartridge assembly.

With certain ink jet cartridge designs, selected electrical traces on the tab circuit are exposed to nearly constant electrical bias as opposed to discrete pulsed electrical bias. Theses "constant power" electrical traces corrode several orders of magnitude faster than electrical traces with discrete pulsed electrical bias. Aqueous ink on theses "constant power" electrical traces further hastens the corrosion of electrical traces carried by the flexible tape of the TAB circuit.

Additionally, there is a trend at least within certain ink jet printers to increase the volume of the ink which is carried within the body of the ink jet cartridge assembly. Since the volume of ink is increased, the corresponding actual total power-on time necessary to empty the ink jet cartridge assembly is likewise increased. This means that the electrical traces of the TAB circuit must have an extended life when compared with throwaway designs which hold a lesser amount of ink within the body. Thus, corrosion of the electrical traces on the TAB circuit is of concern so that the operable life of the TAB circuit may be increased.

What is needed in the art is a TAB circuit which is constructed such that the electrical traces are less likely to corrode during use, thereby increasing the operable life of the TAB circuit.

SUMMARY OF THE INVENTION

The present invention provides a TAB circuit with electrical traces which are entirely coated on the bottom side with a photoimagable coating, except in the area where each trace is connected with the printhead. The tolerance of the coating at the termination adjacent the printhead is very tight when compared with conventional designs.

The invention comprises, in one form thereof, an ink jet cartridge assembly for use in an ink jet printer. A body has at least one inner ink chamber. A printhead is carried by the body and has a plurality of ink jetting orifices in fluid communication with the ink chamber. A tape automated bonding circuit carried by the body includes a flexible tape and a plurality of electrical traces. The flexible tape includes a chip window with a peripheral edge. The printhead is disposed within the chip window at a distance from the peripheral edge. Each electrical trace has a bottom side adjacent the body, a substrate held portion carried by the flexible tape, a free trace portion extending between the peripheral edge of the chip window and the printhead, and a printhead held portion connected with the printhead. The tape automated bonding circuit further includes a photoimagable coating which covers the bottom side of each electrical trace on all of the substrate held portion and the free trace portion, but does not cover the printhead held portion.

An advantage of the present invention is that corrosion of the electrical traces on the bottom side of the TAB circuit is inhibited to a greater extent than heretofore possible.

Another advantage is that the tolerance of the photoimagable coating applied to the bottom side of the traces is much tighter than heretofore possible.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
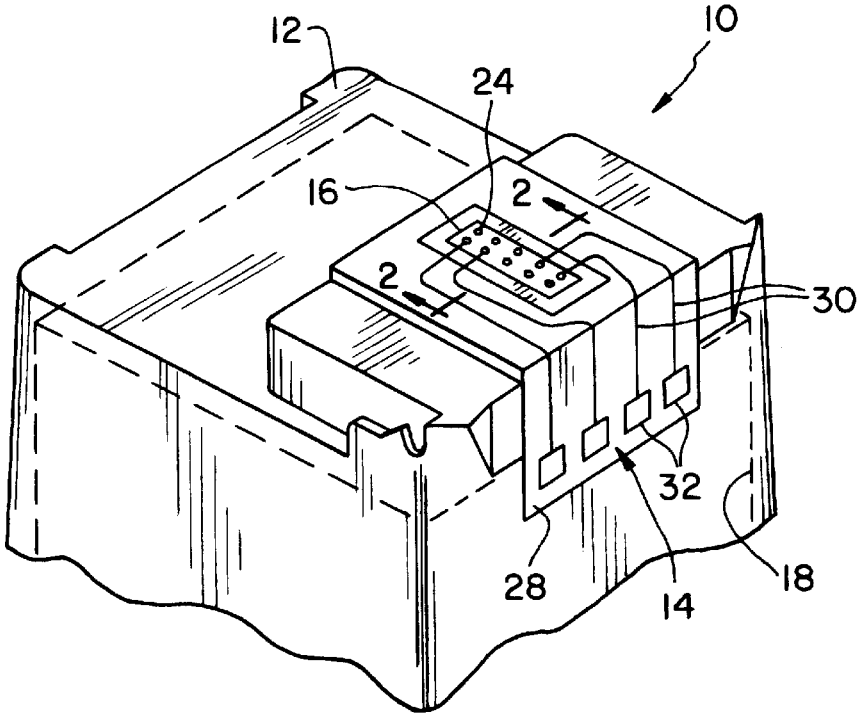
FIG. 1 is simplified perspective view of an embodiment of an ink jet cartridge assembly of the present invention.
Figure 4:
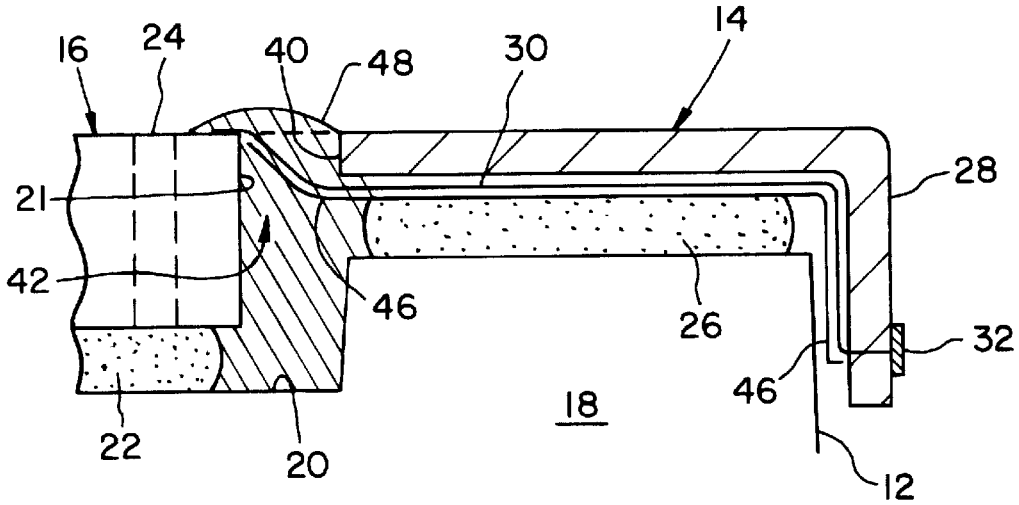
FIG. 4 is an enlarged, sectional view of the ink jet cartridge assembly shown in FIGS. 1 and 2.

Referring now to the drawings, and more particularly to FIG. 1, there is shown an embodiment of an ink jet cartridge assembly 10 of the present invention for use in an ink jet printer. Ink jet cartridge assembly 10 generally includes a body 12, TAB circuit 14 and printhead 16.

Body 12 includes at least one inner ink chamber 18 which is disposed in fluid communication with printhead 16. In the embodiment shown, body 12 includes a single inner ink chamber 18 which is disposed in fluid communication with a single printhead 16. However, it is to be understood that body 12 may include multiple inner ink chambers which respectively contain inks with different colors, hues or saturation densities. If body 12 includes multiple inner ink chambers, ink jet cartridge assembly 10 typically is provided with multiple printheads corresponding to the number of multiple inner ink chambers. Body 12 of ink jet cartridge assembly 10 is shown in an inverted position in FIG. 1 for ease of illustration, but normally is positioned such that printhead 16 faces in a downward direction during use so that gravitational force causes the ink within inner ink chamber 18 to flow to printhead 16.

Figure 2:
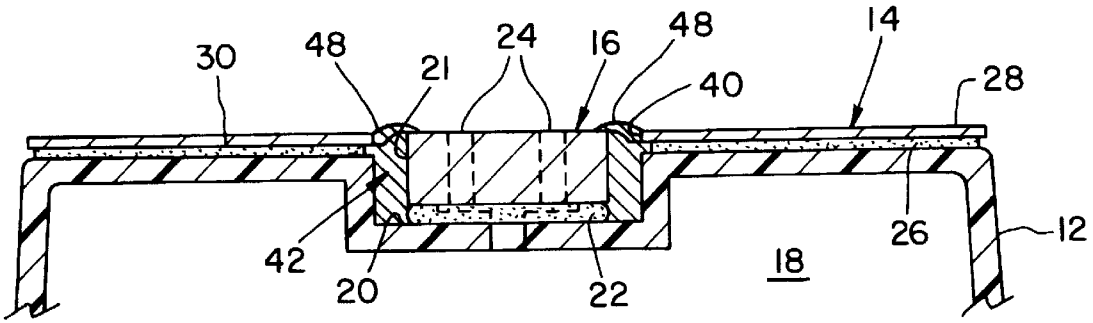
FIG. 2 is a sectional view taken along line 2—2 in FIG. 1.

Printhead 16 is carried by and attached to body 12. More particularly, referring to FIG. 2, body 12 includes a die cavity or recess 20 having a shape which generally corresponds to the shape of printhead 16 and a size which is at least slightly larger than printhead 16. A die adhesive 22 is used to adhesively bond printhead 16 within recess 20 of body 12. In the embodiment shown, die adhesive 22 may be of conventional composition.

Printhead 16 includes a plurality of ink jetting orifices 24 which are disposed in fluid communication with ink chamber 18 within body 12 via appropriate ink feed channels, vias, etc. (not shown) in known manner. A plurality of heater elements (not shown) are disposed within printhead 16 in corresponding relationship with orifices 24. The heater elements cause the rapid formation of a bubble adjacent a corresponding orifice 24 to eject an ink drop toward the print media (not shown).

TAB circuit 14 generally includes a flexible tape 28, a plurality of electrical traces 30 and a plurality of contact pads 32. TAB circuit 14 is carried by body 12 using a preform adhesive 26 which is applied to TAB circuit 14 during manufacture. TAB circuit 14 with preform adhesive 26 thereon may then be pressed against body 12 to adhesively bond TAB circuit 14 with body 12.

Figure 3:
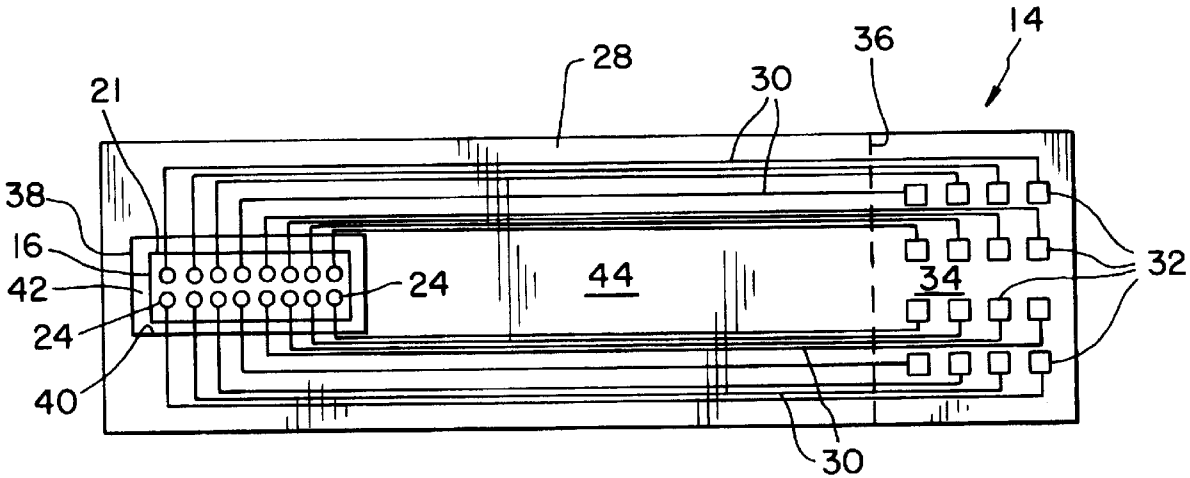
FIG. 3 is a plan view of an embodiment of the TAB circuit of FIGS. 1 and 2.

Contact pads 32 typically are grouped together near one end of flexible tape 28. Contact pads 32 thus define a contact pad area 34, indicated conceptually to the right of dashed line 36 in FIG. 3. Contact pads 32 mechanically engage corresponding electrical terminals on a movable carriage assembly (not shown) within an ink jet printer when ink jet cartridge assembly 10 is snapped into place on the carriage assembly for use. In the embodiment shown, TAB circuit 14 includes contact pads 32. It is to be understood that TAB circuit 14 may include any suitable number of contact pads 32, and likely includes a greater number than shown.

Electrical traces 30 interconnect contact pads 32 with printhead 16. Electrical traces 30 are typically in the form of copper traces which are formed on TAB circuit 14 via an etching process or the like. Electrical traces 30 may be gold-coated copper traces to resist corrosion thereof. Electrical traces 30 may be assigned various functions for proper operation of printhead 16. For example, each electrical trace 30 may be assigned with a power, address or ground function. The actual selection, function and layout of electrical traces 30 may be of known design, and thus is not described further.

Flexible tape 28 also includes a chip window 38 with a shape which generally corresponds to printhead 16 in a size which is larger than printhead 16. More particularly, chip window 38 includes an interior peripheral edge 40 which is larger than border edge 21 of printhead 16. The space between peripheral edge 40 of chip window 38 and border edge 21 of printhead 16 defines a free trace area 42 through which electrical traces 30 extend. Free trace area 42 is defined as extending between and terminating at peripheral edge 40 and border edge 21. It will be appreciated that this free trace area 52 exists on all sides of border edge 21 such that electrical traces 30 could cross over peripheral edge 40 at position 41, or elsewhere, as opposed to the only embodiment depicted in FIG. 3.

Each electrical trace 30 extends between a corresponding contact pad 32 and chip window 38. The portion of flexible tape 28 which carries electrical traces 30 between contact pad area 36 and chip window 38 is defined as a substrate held area, indicated conceptually by reference number 44 to the left of dashed line 36 in FIG. 3. Each electrical trace 30 includes a corresponding substrate held portion which is carried by flexible tape 28 within substrate held area 44. The portion of each electrical trace which is disposed within free trace area 42 is similarly defined as a free trace portion; and the portion of each electrical trace 30 which terminates at an end attached to printhead 16 disposed outside of free trace area 42 is defined as a printhead held portion. The free trace portion and printhead held portion of each electrical trace 30 thus can terminate immediately adjacent to and in line with border edge 21 of printhead 16.

According to an aspect of the present invention, TAB circuit 14 also includes a photoimagable coating 46 which covers most of the bottom side thereof. The "bottom side" is defined as the side of flexible tape 28 and electrical traces 30 which lies adjacent to body 12. In general, photoimagable coating 46 is in the form of a coating which is applied to the entire bottom side of TAB circuit 14, including the entire bottom side of electrical traces 30 and flexible tape 28. Selected portions of photoimagable coating 46 are then etched away using a photo etching process to only leave photoimagable coating 46 on selected portions of the bottom side of flexible tape 28 and electrical traces 20. After being etched away using a photo etching process, photoimagable coating 46 covers all of contact pad area 34 and substrate held area 44 of flexible tape 28. In addition, photoimagable coating 46 covers the substrate held portion and free trace portion of each electrical trace 30. However, photoimagable coating 46 does not cover the printhead held portion of each electrical trace 30. This allows the non-coated printhead held portion of each electrical trace 30 to be properly connected with printhead 16 during manufacture. The free trace portion of each electrical trace 30 must be covered with photoimagable coating to the greatest extent possible to inhibit corrosion in the presence of ink, and still allow for the adequate bonding of the printhead held portion with printhead 16. Accordingly, it has been found that it is necessary to maintain the tolerance of photoimagable coating 46 with in 75 $\mu$m. That is, the photoimagable coating 46 must terminate within 75 $\mu$m of border edge 21 of printhead 16. Photoimagable coating allows a great degree of tolerance control not heretofor possible.

Photoimagable coating 46 may be formulated to be crosslinked in the presence of UV light to facilitate patterning and cured in the presence of heat to achieve enhanced resistance to adverse environment conditions. Suitable materials include photoimagable epoxy acrylates, polyimides, and the like. Available commercial materials include the product sold under the trademark Imageflex by Coates Circuit Products under the part number XV601T; PSR-4000/AUS5 sold by Taiyo America; NPR-80/ID431 sold by Nippon Polytech Corporation; the product sold by Olin-Arch under the trademark Probimide under the series number 7500 and the product sold under the trademark Carapace-A by Electra Polymers and Chemicals America under the part number EMP110.

Photoimagable coating 46 may be formed by applying a layer of a liquid covercoat material using a coating method such as knife coating, extrusion die coating, curtain rod coating, screen printing, spray coating or other suitable methods of forming a layer of covercoat material. The photoimagable coating 46 is then dried at ambient temperature or in a suitable drying apparatus such as an air convection oven. Other methods of forming a covercoat layer such as laminating a dry film layer to the substrate are also possible.

Next photoimagable coating 46 is photoimaged. The photoimaging step includes exposing and developing photoimagable coating 46. The exposure step includes exposing photoimagable coating 46 to a light source such as an ultraviolet (UV) lamp. The depth to which the material is crosslinked relative to the overall thickness of the photoimagable coating 46 is generally a function of the applied exposure energy.

Conventional TAB circuits may include a coating on the bottom side thereof which is silk screened onto selected areas of the TAB circuit. That is, certain areas of the bottom side of the TAB circuit are conventionally masked off, and the coating is applied to the non-masked areas. The tolerance of such coatings is typically between 300–500 $\mu$m. Since the tolerance of conventional coatings is very poor, the coating must be maintained at a relatively large distance from the edge of the printhead to allow for proper attachment between the electrical trace and printhead. This in turn means that the non-coated portions of the electrical traces are likely to corrode in the presence of ink. The photoimagable coating of the present invention which is applied to the bottom side of TAB circuit 14 has very tight tolerances when compared with conventional designs, and thus provides improved corrosion resistance.

To further assist in inhibiting corrosion of electrical traces 30, an encapsulant 48 may be applied in the free trace area 42 between chip window 38 and printhead 16. Encapsulant 48 extends between peripheral edge 40 of chip window 38 and border edge 21 of printhead 16 to inhibit the entry of ink into free trace area 42. Encapsulant 48 at least partially fills free trace area 42.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Addendum

1. Tape Automated Bonding Circuit for Use with an Ink Jet Cartridge Assembly in an Ink Jet Printer

What is claimed is:

1. An inkjet cartridge assembly for use in an inkjet printer, comprising:

a body with at least one inner ink chamber;

a printhead carried by said body, said printhead having a plurality of ink jetting orifices in fluid communication with said ink chamber; and a tape automated bonding circuit carried by said body, said tape automated bonding circuit including a flexible tape and a plurality of electrical traces, said flexible tape including a chip window with a peripheral edge, said printhead disposed within said chip window at a distance from said peripheral edge, each said electrical trace having a bottom side adjacent said body, a substrate held portion carried by said flexible tape, a free trace portion extending between said peripheral edge of said chip window and said printhead, and a printhead held portion connected with said printhead, said tape automated bonding circuit further including a photoimagable coating covering said bottom side of each said electrical trace on all of said substrate held portion and said free trace portion and not covering said printhead held portion.

2. The ink jet cartridge assembly of claim 1, wherein said printhead has a border edge and said photoimagable coating terminates within said free trace portion at a distance of between approximately 0 and 75 $\mu$m from said printhead border edge.

3. The ink jet cartridge assembly of claim 1, wherein said flexible tape includes a substrate held area in which said substrate held portion of each said electrical trace is disposed, said photoimagable coating covering all of said substrate held area.

4. The ink jet cartridge assembly of claim 3, wherein said flexible tape further includes a contact pad area, each said electrical trace having an end associated with said contact pad area, said photoimagable coating covering all of said contact pad area.

5. The ink jet cartridge assembly of claim 4, wherein each said electrical trace has and end which terminates at a corresponding contact pad within said contact pad area.

6. The ink jet cartridge assembly of claim 1, further comprising a die adhesive disposed between and interconnecting said printhead and said body.

7. The ink jet cartridge assembly of claim 1, further comprising an encapsulant within said chip window between said peripheral edge and said printhead, said encapsulant covering said free trace portion of each said electrical trace.

8. The ink jet cartridge assembly of claim 1, wherein said photoimagable coating consists essentially of one of an epoxy acrylate and a polyimide.

9. A tape automated bonding circuit for use with an ink jet cartridge assembly in an ink jet printer, comprising:

a printhead having a plurality of ink jetting orifices;

a flexible tape including a chip window with a peripheral edge, said printhead disposed within said chip window at a distance from said peripheral edge;

a plurality of electrical traces, each said electrical trace having a substrate held portion carried by said flexible tape, a free trace portion extending between said peripheral edge of said chip window and said printhead, a printhead held portion connected with said printhead, and a bottom side generally opposite said flexible tape; and a photoimagable coating covering said bottom side of each said electrical trace on all of said substrate held portion and said free trace portion and not covering said printhead held portion.

10. The tape automated bonding circuit of claim 9, wherein said printhead has a border edge and said photoimagable coating terminates within said free trace portion at a distance of between approximately 0 and 75 $\mu$m from said printhead border edge.

11. The tape automated bonding circuit of claim 9, wherein said flexible tape includes a substrate held area in which said substrate held portion of each said electrical trace is disposed, said photoimagable coating covering all of said substrate held area.

12. The tape automated bonding circuit of claim 11, wherein said flexible tape further includes a contact pad area, each said electrical trace having an end associated with said contact pad area, said photoimagable coating covering all of said contact pad area.

13. The tape automated bonding circuit of claim 12, wherein each said electrical trace has an end which terminates within said contact pad area.

14. The tape automated bonding circuit of claim 9, further comprising a die adhesive disposed between and interconnecting said printhead and said body.

15. The tape automated bonding circuit of claim 9, further comprising an encapsulant within said chip window between said peripheral edge and said printhead, said encapsulant covering said free trace portion of each said electrical trace.

16. A tape automated bonding circuit for use with an ink jet cartridge assembly in an ink jet printer, comprising:

a flexible tape including a chip window with a peripheral edge, said chip window configured for receiving a printhead therein;

a plurality of electrical traces, each said electrical trace having a substrate held portion carried by said flexible tape, a printhead held portion configured for connection with a printhead, a free trace portion between said substrate held portion and said free trace portion and extending from said peripheral edge of said chip window, and a bottom side generally opposite said flexible tape; and photoimagable coating covering said bottom side of each said electrical trace on all of said substrate held portion and said free trace portion and not covering said printhead held portion, said photoimagable coating terminating within said free trace portion at a distance of between approximately 0 and 75 $\mu$m from said printhead held portion.

* * * * *

UNITED STATES PATENT AND TRADEMARK OFFICE

CERTIFICATE OF CORRECTION

PATENT NO. : 6,402,299 B1
DATED : June 11, 2002
INVENTOR(S) : Jan Richard DeMeerleer et al.

It is certified that error appears in the above-identified patent and that said Letters Patent is hereby corrected as shown below:

Column 4
Line 4, delete “52” and insert -- 42 -- therefor.
Line 35, delete “20” and insert -- 30 -- therefor
Line 51, delete “with in” and insert -- within -- therefor.

Column 5
Please delete lines 54, 55 and 56 therefor.
Line 51, in both instances, delete “inkjet” and insert -- ink jet -- therefor.

Signed and Sealed this

Eighteenth Day of February, 2003

JAMES E. ROGAN
*Director of the United States Patent and Trademark Office*